US005287604A

United States Patent [19]

Feyerl

[11] Patent Number: 5,287,604

[45] Date of Patent: Feb. 22, 1994

[54] DEVICE FOR CHANGING THE NEEDLE BOARDS OF AN APPARATUS FOR NEEDLING NONWOVEN WEBS

[75] Inventor: Günther Feyerl, Linz, Austria

[73] Assignee: Textilmaschinenfabrik Dr. Ernst Fehrer Aktiengesellschaft, Leonding, Austria

[21] Appl. No.: 920,139

[22] Filed: Jul. 24, 1992

[30] Foreign Application Priority Data

Jul. 31, 1991 [AT] Austria ..... A 1523/91

[51] Int. Cl.[5] ..... D04H 18/00

[52] U.S. Cl. ..... 28/115; 28/107; 414/331

[58] Field of Search ..... 28/115, 113, 107, 109, 28/112, 111; 414/331

[56] References Cited

U.S. PATENT DOCUMENTS 4,878,799 11/1989 Seto et al. ..... 414/331

*Primary Examiner*—Clifford D. Crowder
*Assistant Examiner*—Amy B. Vanatta
*Attorney, Agent, or Firm*—Collard & Roe

[57] ABSTRACT

To permit a change of the needle boards of an apparatus for needling nonwoven webs, a magazine is provided, which supports the needle boards in superposed slide tracks. The needling apparatus comprises an assembling track, which extends on both sides of vertically movable board carriers, which are arranged in a row and to which the needle boards are detachably secured. The assembling track serves to guide the needle boards, which are adapted to be interconnected by tension-resisting coupling means. To permit the boards to be changed by machine, a board conveyor for the needle boards is provided between the assembling track and the magazine when the latter is in a position for delivering and receiving needle boards, said board conveyor comprises a board track between the magazine and the assembling track, and the slide tracks of the magazine are vertically movable relative to the board track extending between the magazine and the assembling track by increments which correspond to the vertical spacing of the slide tracks.

8 Claims, 7 Drawing Sheets

DEVICE FOR CHANGING THE NEEDLE BOARDS OF AN APPARATUS FOR NEEDLING NONWOVEN WEBS

BACKGROUND OF THE INVENTION

1. Field of the Invention

This invention relates to a device for changing the needle boards of an apparatus for needling nonwoven webs, which apparatus comprises a plurality of vertically movable board carriers, which are arranged in a row extending in the direction of the working width of the apparatus and to which the needle boards are adapted to be detachably secured, and an assembling track, which extends along said row on both sides thereof and is adapted to support and guide the needle boards, which are adapted to be interconnected by tension-resisting coupling means, which device comprises a magazine for supporting a plurality of said needle boards in respective superposed slide tracks.

2. Description of the Prior Art

In needling apparatuses having a relatively large working width, a plurality of independently mounted board carriers are arranged in a row extending in the direction of the working width of the apparatus so that the loads imposed by the reciprocating motion of the board carriers can be taken up in an improved manner. In dependence on the pitch of the board carriers, a plurality of needle boards are provided, which are secured to the board carriers and during the needling operation the needles of the needle boards pierce at a predetermined stroke frequency the web, which is moved between a backing and a stripper. But that arrangement of the needle boards will render the replacement of the needle boards more difficult. Such a replacement will be required when needles have become worn or damaged or when the needle pitch is to be changed. After the needle boards have been detached from the board carriers, the needle boards must be taken up by assembling trucks, which have been pushed into the needling apparatus along an assembling track extending on both sides of the row of board carriers. Thereafter the assembling trucks interconnected by tension-resisting coupling means are extracted from the needling apparatus and after each extraction step the currently leading needle board is lifted by hand from the assembling truck and placed into a magazine which has been provided. Thereafter the now empty assembling truck is uncoupled from the next succeeding assembling truck and is removed. The assembling of new needle boards is effected by the same operations in a reverse sequence: A needle board is taken from the magazine, which has been provided with properly prepared needle boards, and that needle board is placed into an assembling truck, which is then pushed along the assembling track into the needling apparatus so that space is then available for another assembling truck, which is to be coupled and is to receive the next needle board. It is apparent that the needle boards are moved step by step into the needling apparatus until each needle board is disposed under the associated board carrier and can be secured thereto. When the new needle boards have been assembled, the board carriers are raised and the assembling trucks are then extracted from the needling apparatus and stored for use when the needle boards are to be changed again.

SUMMARY OF THE INVENTION

It is an object of the invention to permit the needle boards of a needling apparatus of the kind described first hereinbefore to be changed by structurally simple means and without a need for expensive manual work rather than by the time- and labor-consuming method previously required.

That object is accomplished in accordance with the invention in that a board conveyor for the needle boards is provided between the assembling track and the magazine when the latter is in a position for delivering and receiving needle boards, said board conveyor comprises a board track between the magazine and the assembling track, and the slide tracks of the magazine are vertically movable relative to the board track extending between the magazine and the assembling track by increments which correspond to the vertical spacing of the slide tracks.

By means of the conveyor provided between the assembling track and the magazine arranged in a position for delivering and receiving needle boards, the needle boards can be pushed in mutually opposite directions between the assembling track and the magazine and the board track of said conveyor will permit an undisturbed transfer to the assembling track and to the slide tracks of the magazine. The slide tracks of the magazine can be vertically moved relative to the board track by increments corresponding to the vertical spacing of the slide tracks so that the board conveyor is operable either to pull individual needle boards from the slide tracks of the magazine or to push consecutive needle boards received from the assembling track into respective slide tracks of the magazine. The conditions under which the needle boards are inserted into and extracted from the needling apparatus along the assembling track will be comparable to the conditions under which said operations are performed in the known changing device, particularly if the needle boards are supported by assembling trucks, which can be interconnected by tension-resisting coupling means and are moved along the assembling track by the board conveyor. But in that case a difference from the manually operable known changing devices resides in that the slide tracks of the magazine and the board track extending between the magazine and the assembling track consist of track rails for the assembling trucks so that the needle boards and the assembling trucks supporting the boards are stored in the magazine and it is no longer necessary to place the needle boards on the assembling trucks immediately before the boards are pushed onto the assembling track.

Assembling trucks for supporting the needle boards are usually employed with existing needling apparatuses which are to be provided with a changing device because the assembling tracks for the assembling trucks can readily be provided, e.g., on the stripper. Such assembling trucks will not be required for new apparatuses if the slide tracks of the magazine, the board track between the magazine and the assembling track consist of track rails for directly supporting the needle boards and if the assembling track is provided on the board carriers. Because the needle boards are guided directly on the board carriers, it is no longer necessary to provide means for transferring the needle boards to the board carriers so that the structural design is very simple.

It is desired that the needle boards which have been detached from the associated board carriers can be extracted from the needling apparatus along the assembling track by the board conveyor extending between the magazine and the assembling track. For this reason adjacent needle boards or assembling tracks must be interconnected by tension-resisting coupling means. Various coupling means may be used for that purpose. A particularly desirable design will be achieved if each needle board or assembling truck is provided at opposite ends with coupling elements, which are vertically movable into and out of engagement with such coupling means of an adjacent needle board or assembling truck because in that case the needle board or assembling truck disposed on a slide track of the magazine will automatically be coupled to or uncoupled from an adjacent needle board or assembling truck on the board track of the board conveyor when the slide tracks of the magazine have been raised or lowered to the position required for delivering or receiving a needle board.

The vertical movement of the slide tracks of the magazine relative to the board track of the adjacent conveyor may be effected by a vertical drive, which is associated with the magazine. But in that case a separate vertical drive will be required for each magazine. To avoid that expenditure, a vertical drive consisting of an intermittent conveyor may be provided for cooperating with the magazine when it is in position for delivering and receiving needle boards. Because the needling zones of needling machines are often disposed above the floor level, a vertical drive is required for lifting the magazines to the position for delivering and receiving needle boards and that conveyor may be operated also as an intermittent conveyor.

Because the board conveyor between the magazine and the assembling track will generally engage the needle boards or assembling trucks at opposite ends thereof when it is desired to insert said boards or trucks into or to extract them from the needling apparatus, it is recommendable to use a board conveyor which consists of a pusher conveyor, which is provided with pushers, which are movable between operative and inoperative positions and are used to insert and extract needle boards in alternation.

DETAILED DESCRIPTION OF THE PREFERRED EMBODIMENT

Figure 1:
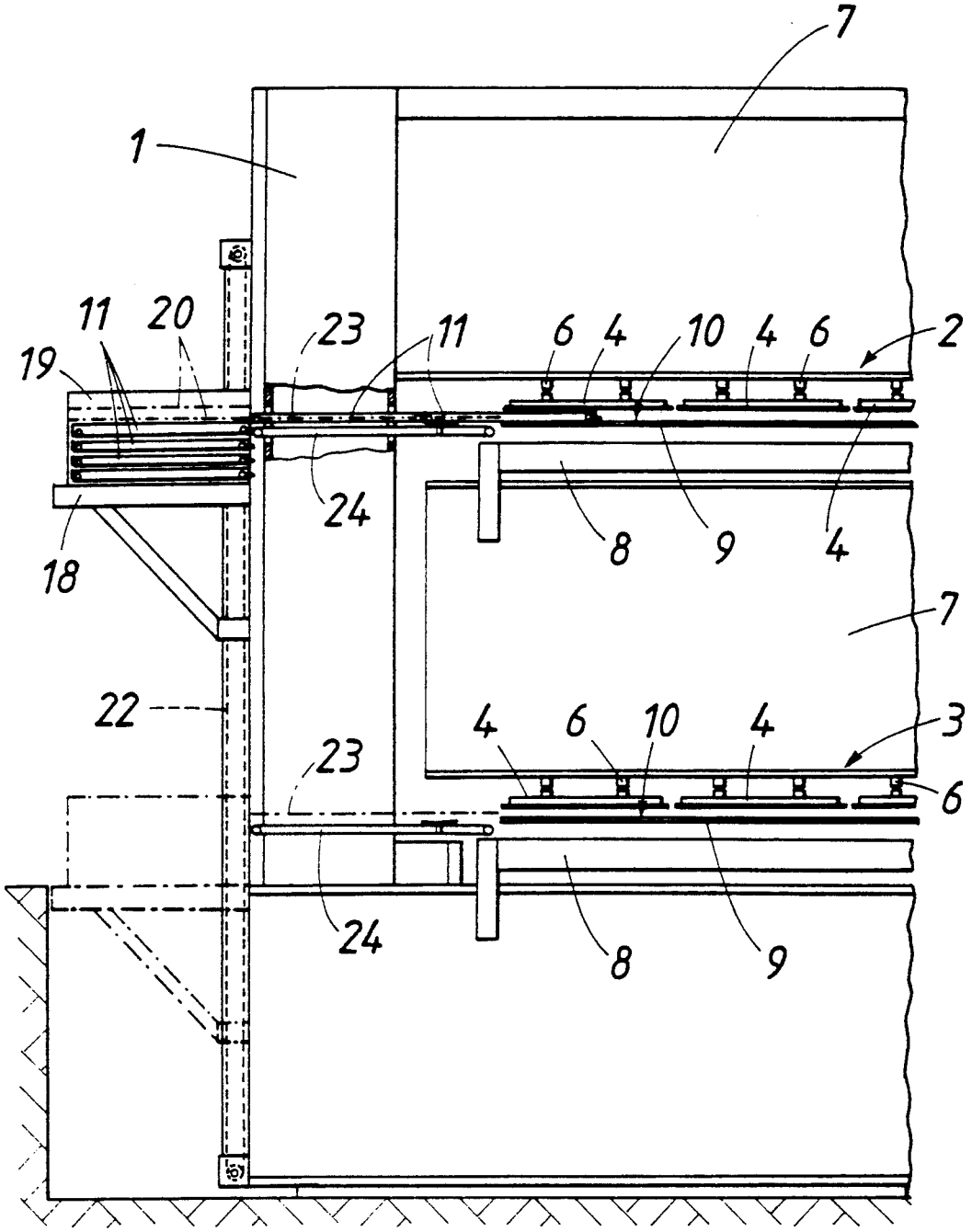
FIG. 1 is a fragmentary schematic transverse sectional view showing a part of a needling apparatus provided with a device in accordance with the invention for changing the needle boards of the needling apparatus.
Figure 2:
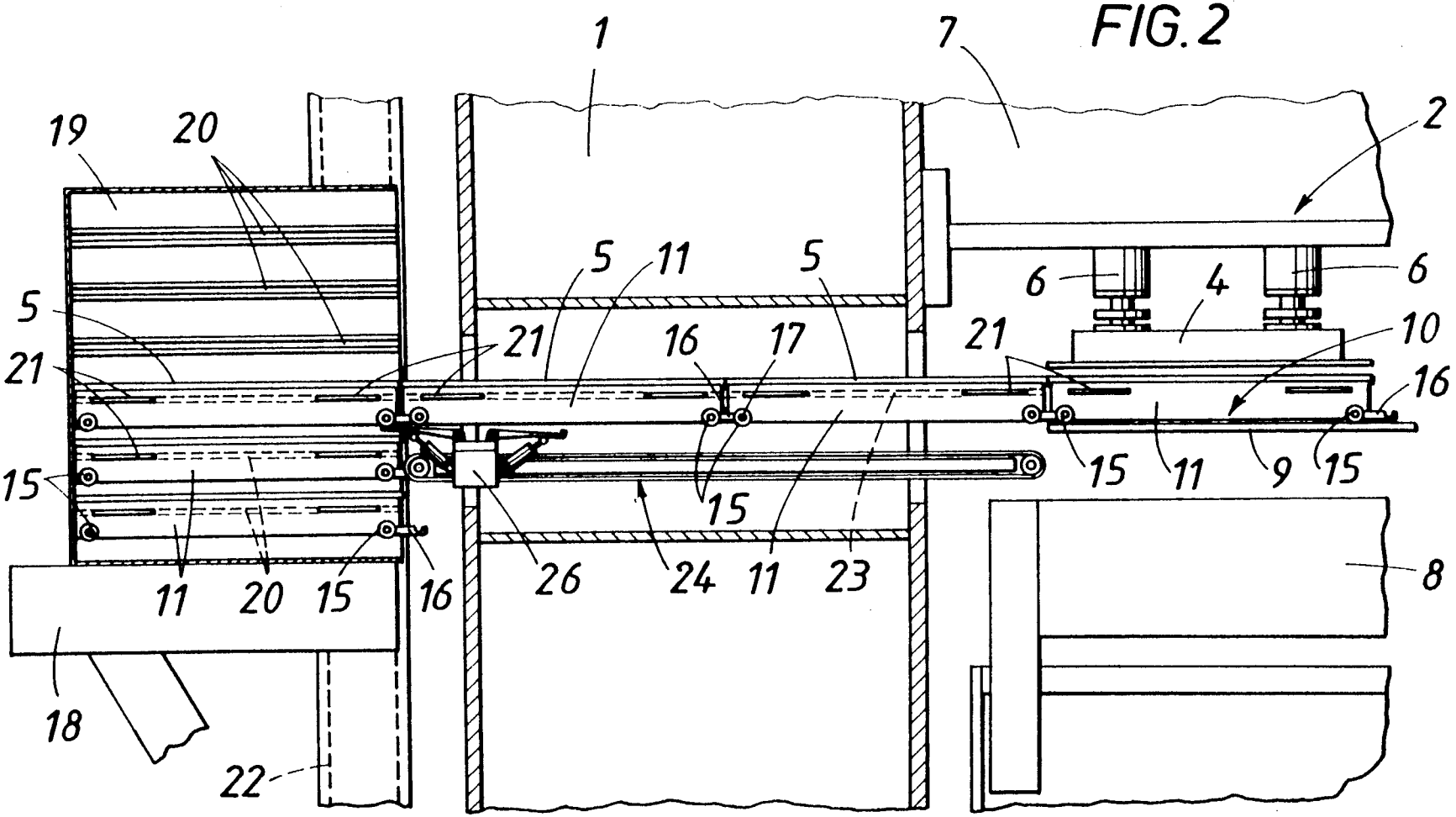
FIG. 2 is a simplified side elevation showing on a larger scale the board conveyor for moving the needle boards between the assembling track and a magazine.
Figure 3:
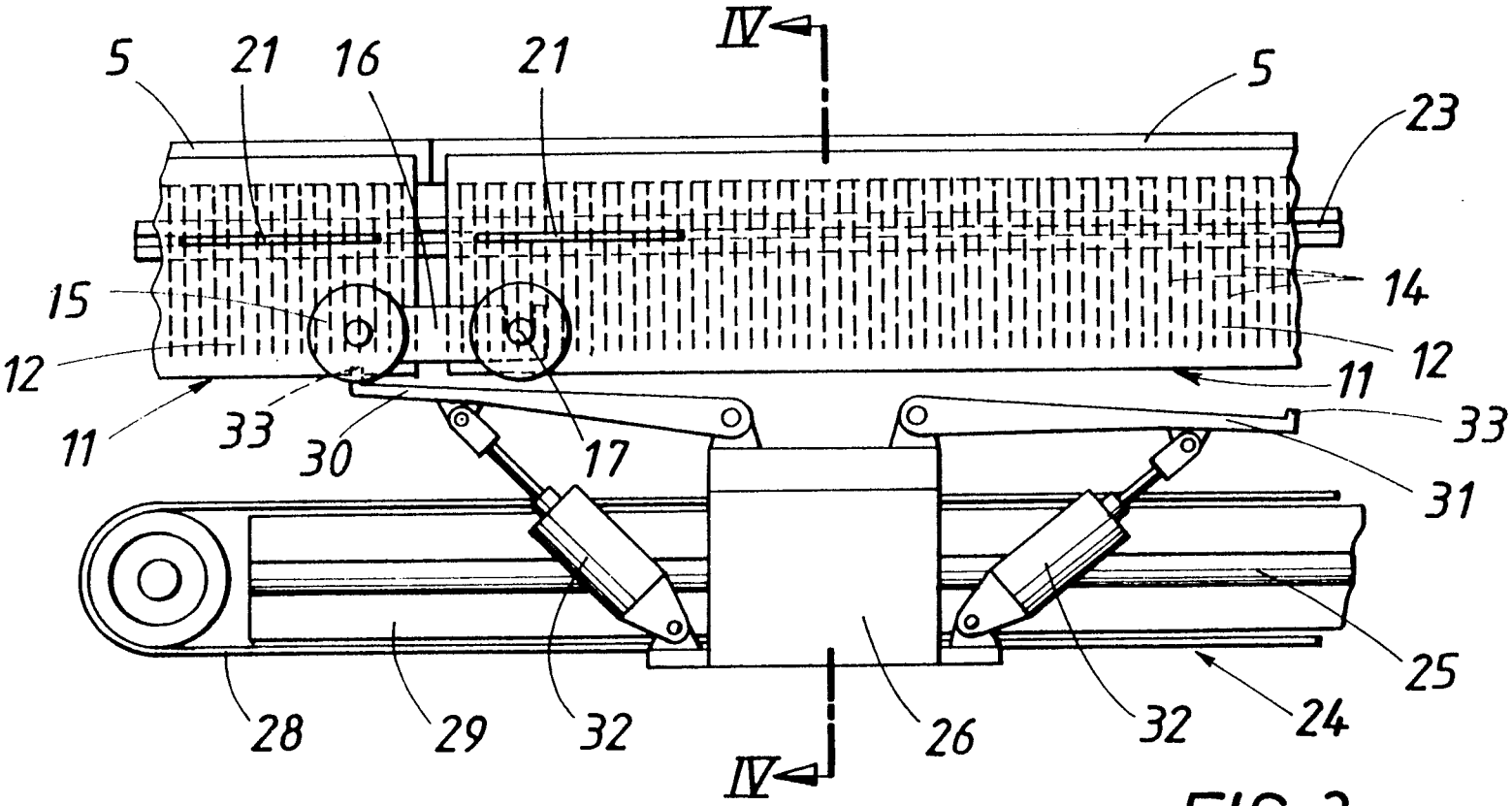
FIG. 3 is a side elevation showing on a larger scale the pushers of said conveyor, which are movable between operative and inoperative positions.

Embodiments of the invention will now be described with reference to the drawing.

The needling machine 1 shown in FIG. 1 comprises two needling apparatuses 2 and 3 for needling a nonwoven web from the inside and outside while said web is moved along a loop-shaped path. The two needling apparatuses 2 and 3 are identical and consist of board carriers 4, which are arranged in a row and to which respective needle boards 5 are secured in known manner by means of screws or clamps, which may be automatically actuated. The board carriers 4 are connected by push rods 6 to a reciprocating vertical drive, which usually consists of an eccentric drive. A separate drive housing is associated with each board carrier 4 and is connected to a common support 7 for said housings. The nonwoven web which is to be needled is moved between a backing 8 and a stripper 9. The members 8 and 9 may consist, e.g., of perforated plates, through which the needles can extend.

Figure 4:
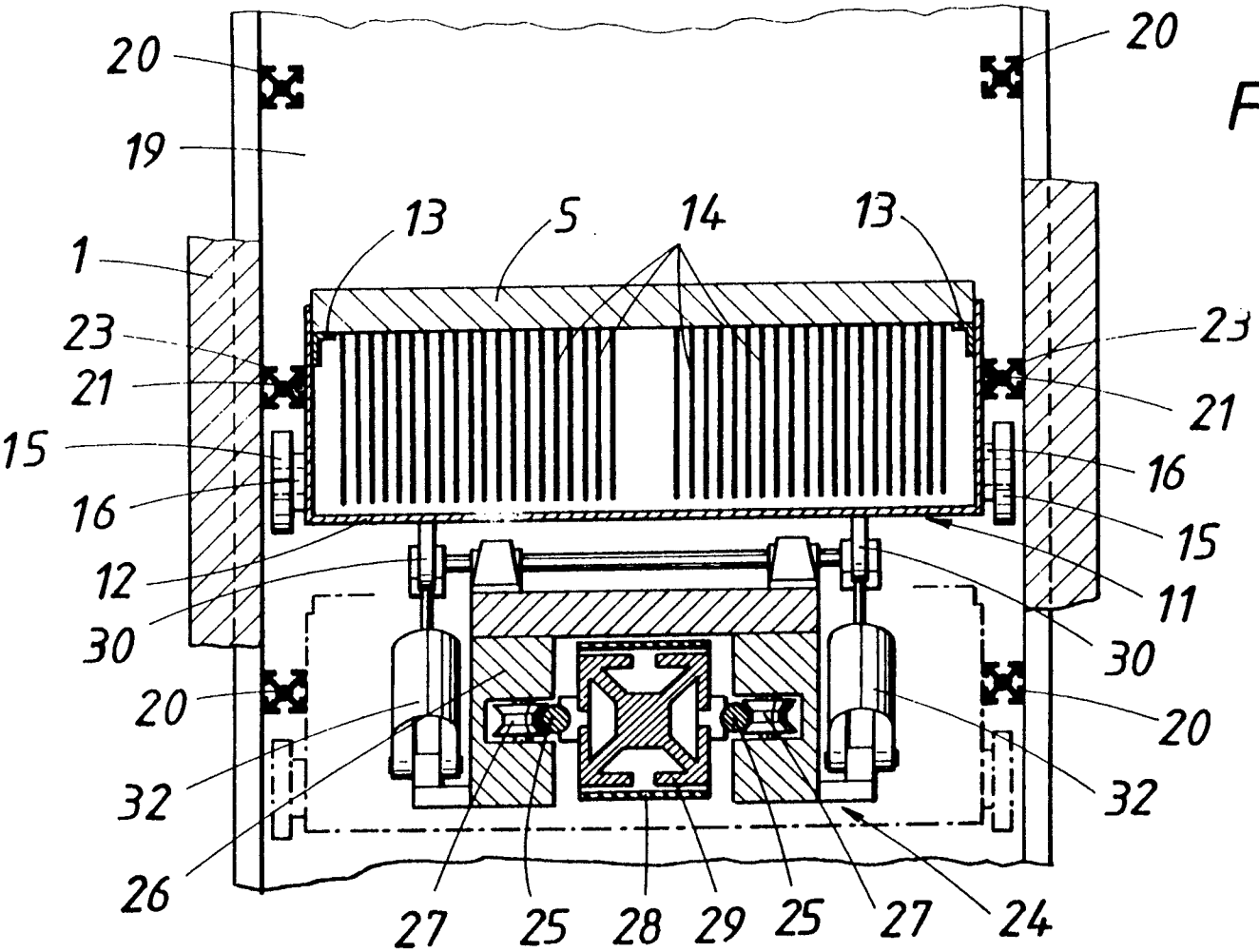
FIG. 4 is a sectional view taken on line IV—IV in FIG. 3.
Figure 5:
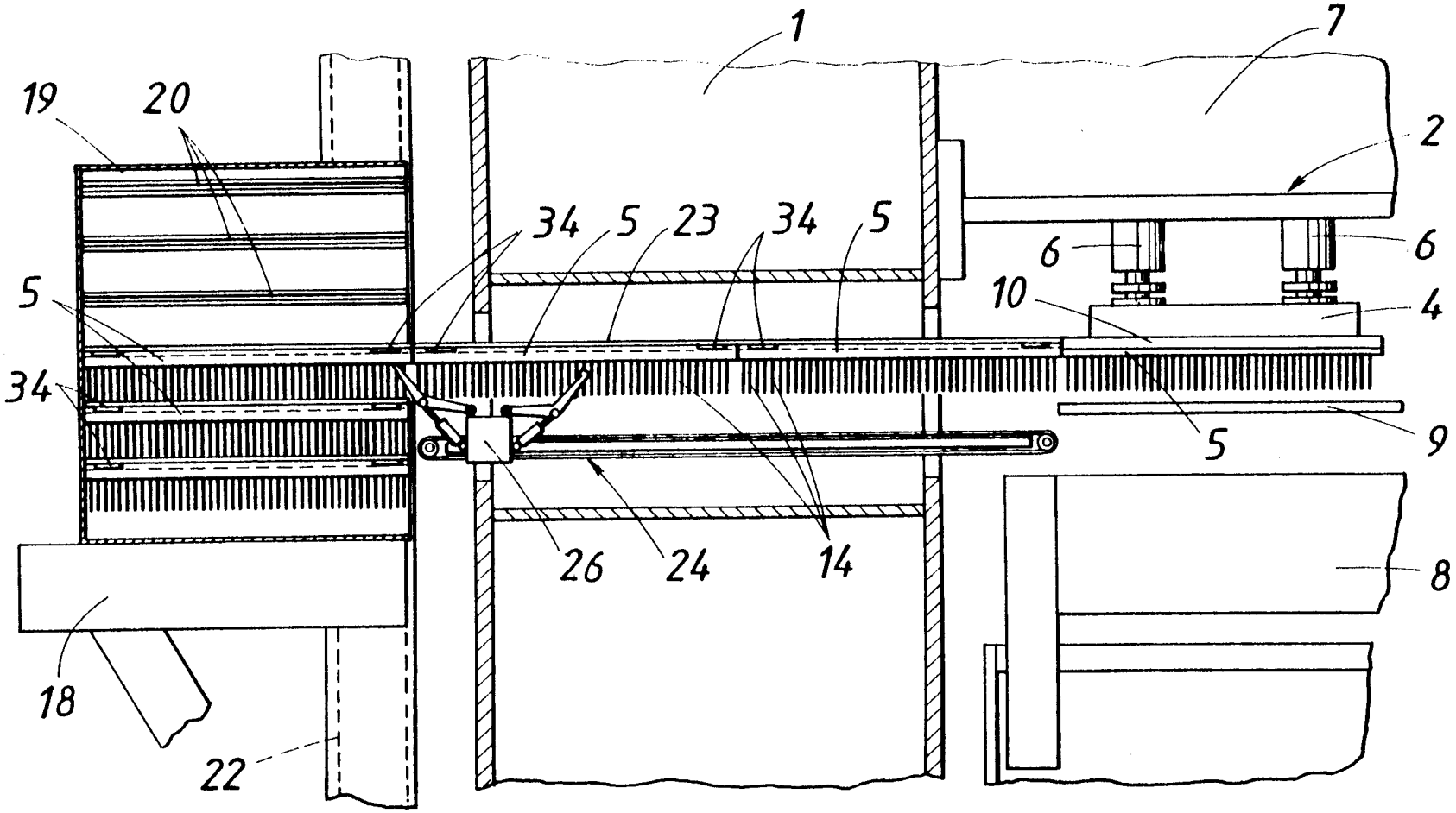
FIG. 5 is a view that is similar to FIG. 2 and shows a modified changing device.

Individual needle boards 5 will have to be changed when the needles have become worn or damaged or when boards having a different needle pitch are required. For such a change of needle boards, an assembling track 10 extends in each needling apparatus 2 or 3 on both sides of the row of board carriers. In the illustrative embodiments shown in FIGS. 1 to 4 that assembling track is constituted by the stripper 9 and serves to support and guide assembling trucks 11, which are adapted to support respective needle boards 5. For that purpose each assembling truck 11 comprises a tublike truck body 12, which carries bars 13 for supporting the needle board 5, the needles 14 of which protrude into the tub, as is particularly apparent from FIG. 4. The assembling trucks 11 are provided with rollers 15, with which they are movable on the assembling track 10 along the stripper 9. Besides, adjacent assembling trucks 11 can be interconnected by tension-resisting coupling means, which may consist, e.g., of coupling hooks 16, which are attached to one end of each assembling truck 11 and upon a vertical movement of adjacent assembling trucks relative to each other will embrace or disengage the axles 17 of the rollers 15 at the adjacent end of the adjacent truck.

In longitudinal alignment with the assembling track 10, a lifting platform 18 is provided laterally beside the needling machine 1 and is operable to lift a magazine 19, in which several needle boards are supported by vertically spaced apart slide tracks 20. Said slide tracks 20 are constituted by profiled rails, which receive sliders 21, which are attached to the sides of the truck bodies 12. In FIG. 1 a chain drive 22 is indicated, which constitutes a vertical drive for the lifting platform 18 and is designed to be vertically adjusted by increments which correspond to the vertical spacing of the slide tracks 20 of the magazine when the latter is in position for delivering and receiving needle boards. As a result, the assembling trucks 11, which support the needle boards 5, can consecutively be extracted from the slide tracks 20 of the magazine 19 and can be pushed onto a board track 23, which extends between the assembling track 10 and the magazine 19 when the latter is in position for delivering and receiving needle boards. A board conveyor 24 comprising the board track 23 is operable to push the boards in mutually opposite directions between the magazine 19 and the assembling track 10. In the illustrative embodiment shown this is accomplished by means of a pusher head 26, which is guided on two guide rods 25 by means of profiled guide rollers 27 and can be displaced along the guide rods 25 by means of a revolving toothed belt drive 28. A support 29 is provided for the guide rods 25 and the toothed belt drive 28. The pusher head 26 is U-shaped and embraces the support 29 and is provided with pivoted first and second pushers 30 and 31, which are operative in alternation and can be moved between operative and inoperative positions by means of swiveling cylinders 32. The coupling hooks 33 of the pushers 30 and 31 extend into mating coupling recesses in the bottom of the assembling trucks 11 so that the latter can be moved along the board track 23 between the magazine 19 and the assembling track 10 in mutually opposite directions.

When it is desired to insert a new set of needle boards into the needling apparatus 2 or 3 and to secure said boards to the board carriers 4, the magazine 19, which is preferably provided with rollers, is placed on the lifting platform 18 in a predetermined position and is then moved to the predetermined position for a delivery and receipt of boards to and from the respective needling apparatus. In that position the uppermost assembling truck 11, for instance, can be extracted by means of the board conveyor 24 from the magazine 19 onto the board track 23. By the vertical drive 22 the magazine 19 is then raised one increment so that the then uppermost assembling truck 11 is engaged by the pusher head 26, which has been retracted to its initial position for that purpose, and now uppermost assembling truck can then be extracted by the pusher head 26 out of the magazine whereas the previously extracted assembling truck is pushed further ahead. During the lifting movement of the magazine 19 the coupling hook 16 of one assembling truck embraces the wheel axle 17 of the adjacent assembling truck so that the assembling trucks are automatically coupled. That automatic coupling is of considerable importance for the extracting of the assembling trucks out of the needling apparatus.

In the manner described, the assembling trucks 11 provided with the needle boards 5 are intermittently pushed from the board track 23 onto the assembling track 10 and are pushed along the stripper 9 into the needling apparatus until the needle boards 5 are disposed under respective board carriers 4. Thereafter the needle boards can be connected to the board carriers by suitable means and the board carriers 4 can then be raised so that the assembling trucks 11 can be extracted from the needling apparatus under the needle boards 5. This is effected by means of the board conveyor 24, which now intermittently moves the assembling trucks 11 from the assembling track 10 and into the magazine 19 by means of the pusher 31. The magazine 19 must be lowered by one increment between each conveying step of the board conveyor 24 and the next. By that descent of the magazine 19 the coupling hook 16 of the leading assembling truck will disengage the axle 17 of the next following assembling truck. By the next following conveying step of the board conveyor 24, the currently leading assembling truck can be pushed into the next upper slide track 20 of the magazine and these operations can be repeated until the magazine has been filled.

To extract the needle boards 5 from either of the needling apparatuses the operations described will be performed in the reverse sequence. The assembling trucks 11 must first be moved onto the assembling track 10 before the needle boards can be disconnected from the board carriers 4 and deposited on the assembling trucks and moved by the latter from the needling apparatus 2 or 3 into the magazine 19.

Figure 6:
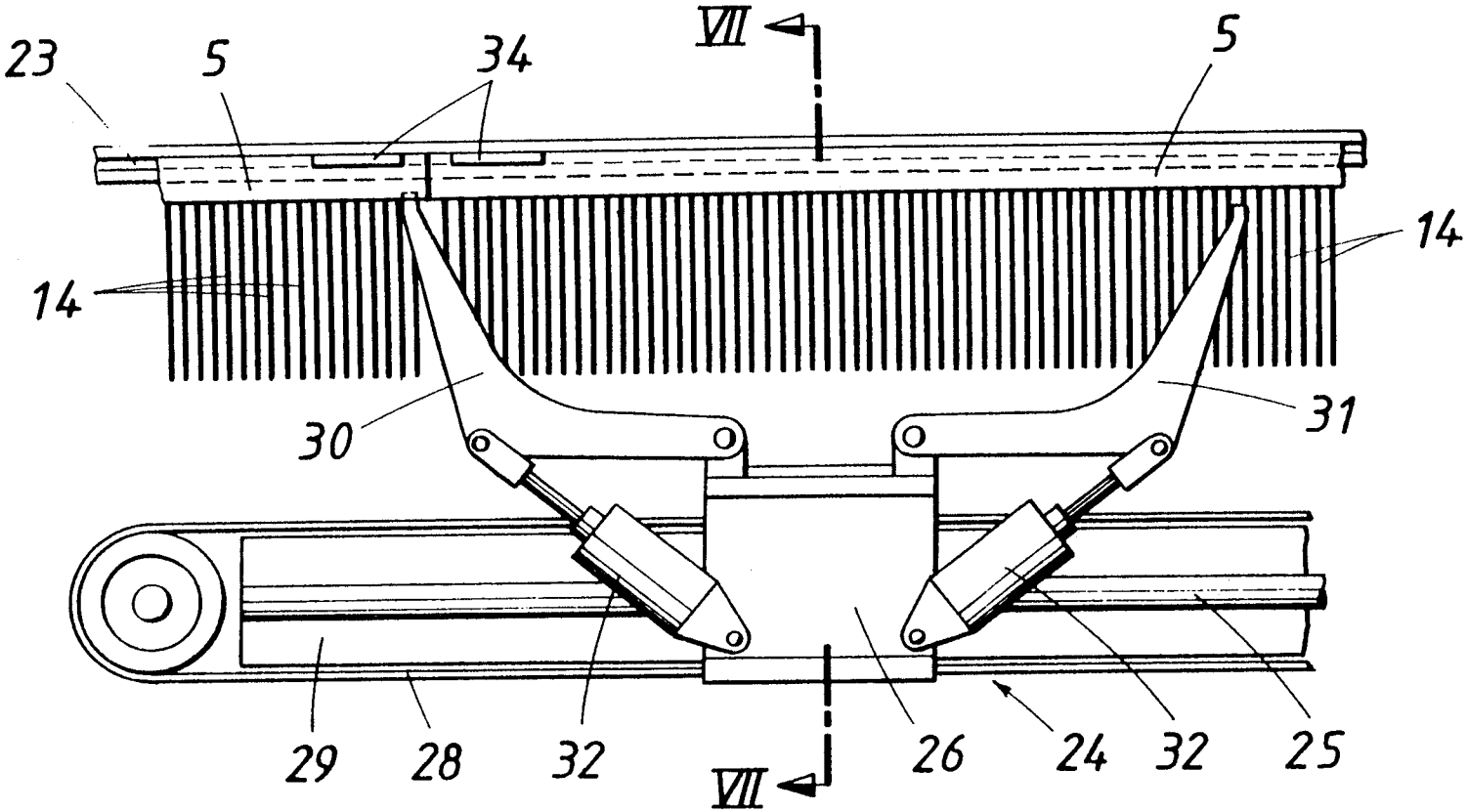
FIG. 6 is a side elevation showing on a larger scale the pushers of the conveyor of FIG. 5, which are movable between operative and inoperative positions.
Figure 7:
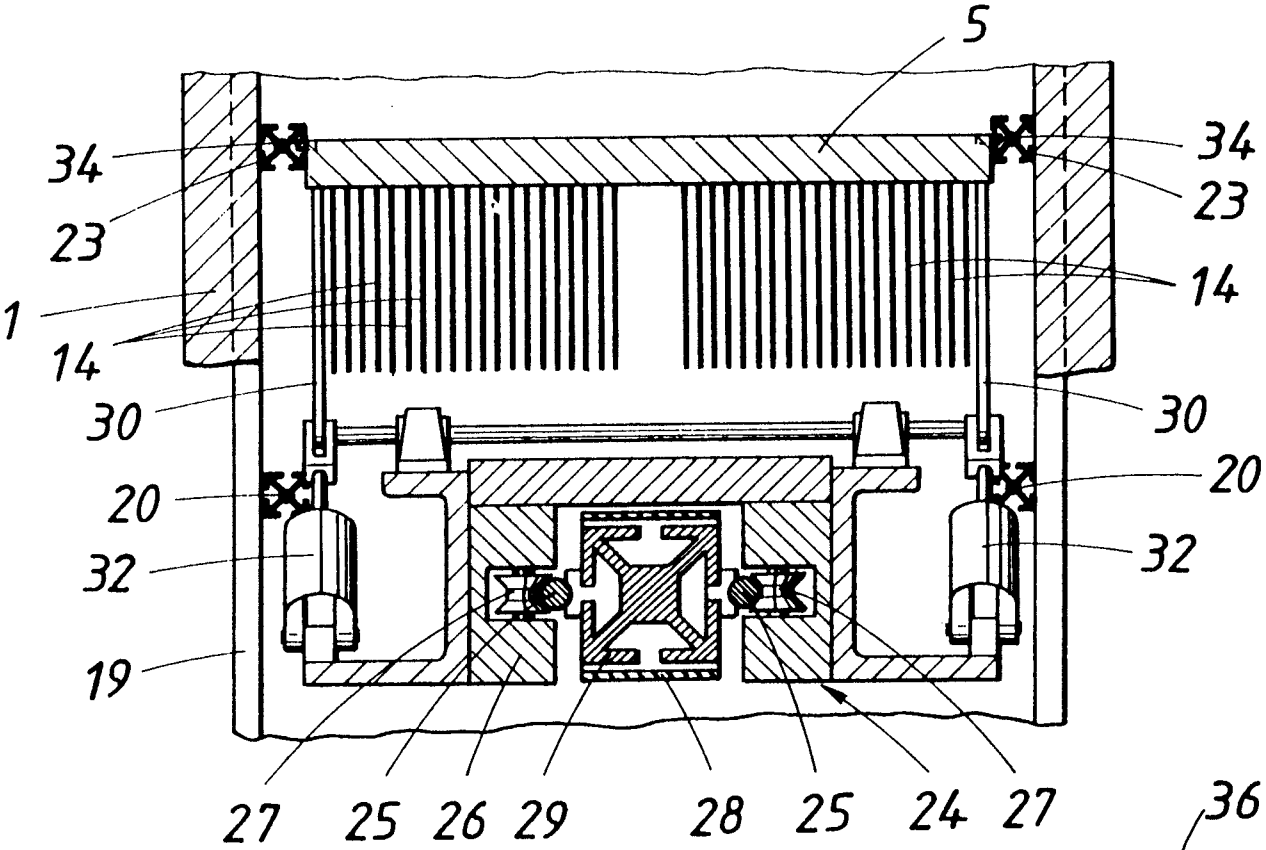
FIG. 7 is a sectional view taken on line VII—VII in FIG. 6.
Figure 8:
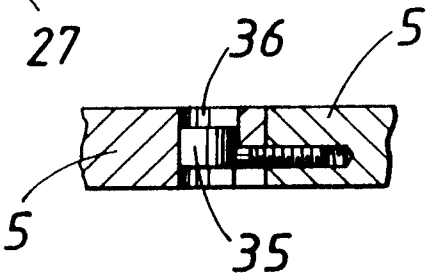
FIG. 8 is a sectional view showing on a larger scale the means for coupling two needle boards.

The illustrative embodiment shown in FIGS. 5 to 8 differs from the design shown in FIGS. 1 to 4 essentially only by the fact that there are no separate assembling trucks for supporting the needle boards. Unless separate transfer means are provided, the omission of such assembling trucks necessitates the arrangement of assembling track 10 on the board carriers 4. This can be accomplished in a very simple manner by the provision of sliders 34, which laterally protrude from the needle boards 5 and are received by track grooves formed in the board carriers 4. Said sliders 34 may also be used to guide the needle boards on the board track 23 and on the slide tracks 20 if said board track 23 and the slide tracks 20 of the magazine 19 are constituted by track rails for the sliders, as is indicated in FIGS. 6 and 7. Adjacent needle boards 5 can again be coupled by coupling elements which are vertically movable into and out of engagement. For that purpose the needle boards 5 are provided at one end with a coupling head 35, as is shown in FIG. 8, for entering a vertical receiving bore 36 formed in the adjacent board. The operations performed for a changing of boards are the same as in the changing device shown in FIGS. 1 to 4.

I claim:

1. In the combination of an apparatus for needling nonwoven webs by a plurality of needle boards and of a device for changing said needle boards, wherein said apparatus comprises a plurality of vertically movable board carriers arranged in a row extending across said apparatus and detachably connectable to respective ones of said needle boards, tension-resisting coupling means for interconnecting said needle boards, and an assembling track extending along said row on both sides thereof for supporting said needle boards and guiding them to and from positions under said board carriers when said needle boards are disconnected from said board carriers, and said device for changing said needle boards comprising a magazine comprising a plurality of vertically spaced apart slide tracks for supporting respective needle boards and assuming an operative position for delivering and receiving needle boards to and from said assembling track, said device comprising the improvement including a board conveyor including a board track extending between said assembling track and said magazine when the magazine is in said operative position, said slide track being vertically movable in unison to selectively move each of said slide tracks into longitudinal horizontal alignment with said board tracks, and said board conveyor being operable to move one of said needle boards at a time in either direction on said board track between said assembling track and any one of said slide tracks when said board conveyor is in longitudinal horizontal alignment with said board track.

2. The improvement set forth in claim 1, wherein said slide tracks are uniformly vertically spaced apart and said device for changing said needle boards comprises a vertical conveyor for vertically moving said slide tracks in unison by increments which are equal to the vertical spacing of said slide tracks.

3. The improvement set forth in claim 2, wherein said vertical conveyor is arranged to support and vertically move said magazine when the magazine is in said operative position.

4. The improvement set forth in claim 1 wherein, said device for changing said needle boards comprises a plurality of assembling trucks, adapted to be supported and guided by said assembling track and to support respective ones of said needle boards, said coupling means establishing a tension-resisting connection between adjacent ones of said assembling trucks, said slide tracks and said board track consisting of track rails for supporting and guiding said assembling trucks.

5. The improvement set forth in claim 1, wherein said assembling track is provided on said board carriers and said slide tracks, said board track and said assembling track consist of track rails for directly supporting and guiding said needle boards.

6. The improvement set forth in claim 1, wherein each of said needle boards is provided at opposite ends with coupling means, which are movable into and out of engagement with such coupling means of an adjacent needle board by a vertical movement of said adjacent needle boards relative to each other.

7. The improvement set forth in claim 1, wherein said device for changing said needle boards comprises a plurality of assembling trucks adapted to be supported and guided by said assembling track and to support respective ones of said needle boards, said coupling means establishing a tension-resisting connection between adjacent ones of said assembling trucks, and each of said assembling trucks is provided at opposite ends with coupling means movable into and out of engagement with such coupling means of an adjacent assembling truck by a vertical movement of said adjacent assembling trucks relative to each other.

8. The improvement set forth in claim 1, wherein said board conveyor comprises a pusher conveyor comprising first and second pushers for moving one of said needle boards at a time on said board track in mutually opposite, first and second directions, respectively, which first and second pushers are selectively movable between operative and inoperative positions.

* * * * *